United States Patent [19]

Noll

[11] Patent Number: 4,869,611

[45] Date of Patent: Sep. 26, 1989

[54] BINGO CARD MARKER

[76] Inventor: Denise Noll, 145 Miller Rd., Getzville, N.Y. 14068

[21] Appl. No.: 220,486

[22] Filed: Jul. 18, 1988

[51] Int. Cl.[4] ..... B43K 8/02

[52] U.S. Cl. ..... 401/6; 401/7; 401/8; 401/176; 401/178; 401/203; 401/204

[58] Field of Search ..... 401/203, 204, 176, 178, 401/6, 7, 8

[56] References Cited

U.S. PATENT DOCUMENTS

| | | | |
|---|---|---|---|
| D. 274,697 | 7/1984 | Venne | D9/352 |
| 464,502 | 12/1891 | Holyland | 401/176 |
| 544,452 | 8/1895 | Young, et al. | 401/176 |
| 744,455 | 11/1903 | Alwart | 401/8 |
| 774,558 | 11/1904 | Browne | 401/7 |
| 1,322,862 | 11/1919 | Ziporyn | 401/6 |
| 1,720,369 | 7/1929 | McCue | 401/178 |
| 1,896,589 | 2/1933 | Mulhollen | 401/176 |
| 3,343,200 | 9/1967 | During | 401/204 X |
| 4,511,272 | 4/1985 | Brown et al. | 401/6 |
| 4,738,556 | 4/1988 | Brown | 401/8 X |

FOREIGN PATENT DOCUMENTS

| | | | |
|---|---|---|---|
| 353369 | 5/1922 | Fed. Rep. of Germany | 401/6 |
| 19839 | 4/1909 | Norway | 401/176 |

*Primary Examiner*—Steven A. Bratlie
*Attorney, Agent, or Firm*—James J. Ralabate

[57] ABSTRACT

This is a unit particularly suited for marking bingo cards and the like. The unit has an ink bottle that is attached to the user's arm. It also has an ink nib that delivers ink to a substrate such as a bingo card. A flexible tube permits the ink to flow from the bottle to the ink nib dispenser. The nib also is connected to the user's finger to a VELCRO Fastener or other suitable means.

9 Claims, 1 Drawing Sheet

BINGO CARD MARKER

This invention relates to a marking device and, more particularly, to a novel marker for bingo cards and the like.

BACKGROUND OF THE INVENTION

In various games like bingo, one of the frustrating elements is marking a card rapidly in a substantially visible and permanent fashion. Cards so marked must retain the marking without shifting or moving during the game. When disposable cards are used, various systems of marking have been used such as discs, pens, crayons or ink bottles. Most of these markers are frequently lost or forgotten in the bingo hall after use. One of the most popular marking systems presently is the ink bottle containing an opaque marking ink. The ink bottles such as the type described in U.S. Des. patent No. 274,697 have an opaque or colored ink in a plastic bottle with a nib or felt top. The bottle is inverted during use, the ink saturates the nib, and the top is pressed onto the desired number to thereby mark it. Since the game of bingo is frequented by senior citizens, some of whom are afflicted with arthritic conditions, holding an ink bottle for extended periods of time becomes a difficult chore. Also, it is common that people will forget their ink bottle marker and leave the markers in the bingo hall or elsewhere. Also, holding an ink bottle frequently soils the hand and becomes messy to use. In addition, frequent pressing down of the plastic bottle could, during extended use, develop leaks along the cap portion or, more likely, along the nib applicator.

There are various devices used for marking substrates such as those disclosed in U.S. Pat. Nos. 2,143,712; 3,003,184 and 3,436,163. In 2,143,712 a marker is disclosed comprising a reservoir in the marker handle to contain a fluid, and at the end portion is located a fluid-absorbing dauber. A rubber sleeve that is flexible during use fits around the dauber. As the marker is pressed down, the rubber sleeve is flexed and the dauber absorbs ink and can be used to mark a substrate. As the sleeve is continued to be stretched during use, it is not uncommon for leaks to develop and the ink fluid to escape from the reservoir.

In U.S. Pat. No. 3,003,184 (Rosenthal) a marking device is disclosed where an ink is supplied in a free flowing condition from an ink container or reservoir to a nib through a valve controlled opening between the carrier and the nib. The valve on this type device comprises a ball of corrosion-resistant metal, as stainless steel which is biased against a valve seat by a compression spring. When the marking device is pressed down the spring contracts lifting the valve ball and permitting ink to flow through to a nib at the outer end opening of the container. Again, as mentioned above, markers such as Rosenthal's have a tendency to leak upon continued and frequent use. This is caused by the marking nib and the ink container being on one and the same device. Because the pressure needs to be exerted on the nib for ink to flow, this same pressure must be exerted upon the ink container or reservoir causing the reservoir to eventually leak.

In U.S. Pat. No. 3,436,163 (Calabrese) a bingo game marker is disclosed having two compartments, one (upper) to hold a supply of ink, and the bottom compartment to hold a supply of marking discs. The upper compartment has a flat pad of sponge rubber which absorbs the ink and transfers it to a substrate upon the exertion of pressure thereon. In Calabrese's marker also, the pressure is exerted upon the reservoir of ink or discs to release the marker to a substrate. The problems here are the same as in the Rosenthal device, i.e. pressure causes eventual leakage of the liquid marker because of the required repeated forces to release the marker.

SUMMARY OF THE INVENTION

It is therefore an object of this invention to provide a bingo marker that is devoid of the above-noted disadvantages.

Another object of this invention is to provide a bingo card marker wherein no direct pressure is exerted upon the ink reservoir.

A further object of this invention is to provide a bingo card marker that is simple, easy to use and effective.

A yet further object of this invention is to provide a bingo marker wherein the only pressure exerted is pressure upon the ink dispenser and not on the ink reservoir.

A still further object of this invention is to provide a bingo card marking device that is attached to the user's hand and arms and minimizes the chance of losing or forgetting it.

Another yet further object of this invention is to provide a bingo card marking device that can easily be used by people afflicted with arthritic or other disabling conditions.

These and other objects will be provided, generally speaking, by a bingo card marker comprising an ink reservoir or container and an ink dispensing unit separated from the ink reservoir. Connecting the reservoir and the nib is a plastic tube. The nib has a VELCRO fastener for attaching the nib portion to the forefinger. The ink reservoir also has a VELCRO fastener attached to it to connect the reservoir around the user's wrist. The ink flows from the ink reservoir, through the plastic tube and wets the nib on the ink dispenser. To deliver an ink mark to a substrate, the user merely presses the ink dispenser's nib to the substrate to be marked. The nib can take many simple forms; the preferred embodiment comprises a two-piece cylindrical outer structure, one telescoping within the other. The lower cylindrical piece has a nib on its bottom portion made from felt, rubber or other absorbent material. The upper or cap cylindrical piece has a flat, disc-like surface adapted to be pressed by a finger. The upper or lower cylindrical piece has a tube opening to receive the plastic tube extending from the reservoir. Inside and in contact with inner sections of both cylindrical pieces is a spring which is depressed by pressing on the upper disc-like surface of the cap cylinder to release ink to the nib. Then from the nib, ink is transferred to a substrate.

The ink containers used can be any suitable ink bottle, many which are presently available. These bottles have a screw-on top with a pointed exit portion which is easily attached to a plastic tube. A commercially available ink is the type called DAB-O-INK available from American Coding and Marketing Co., of 1220 North Avenue, Plainfield, N.J. 07062, and other suitable inks can also be used.

DESCRIPTION OF THE DRAWING AND PREFERRED EMBODIMENT

Figure 1:
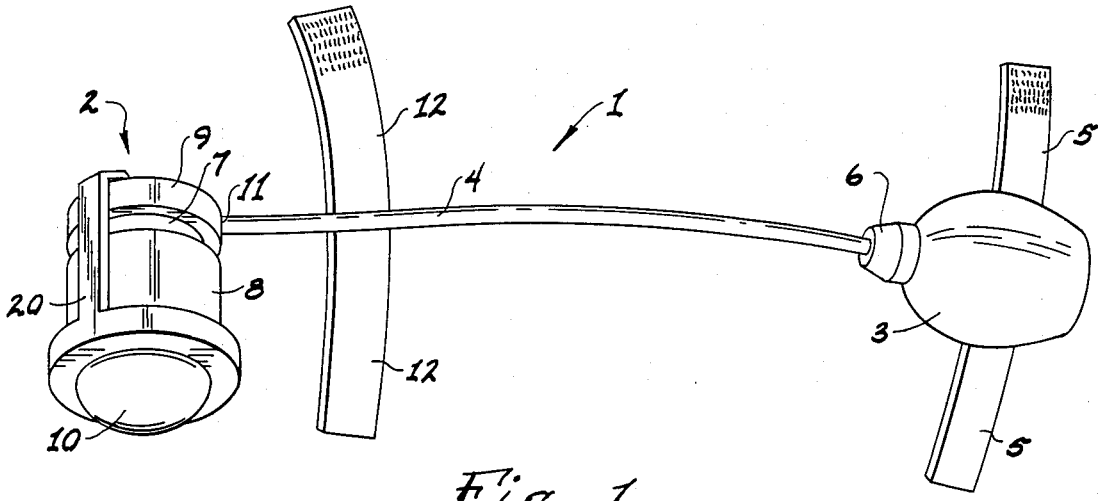
FIG. 1 is a perspective view of the complete unit of this invention.
Figure 3:
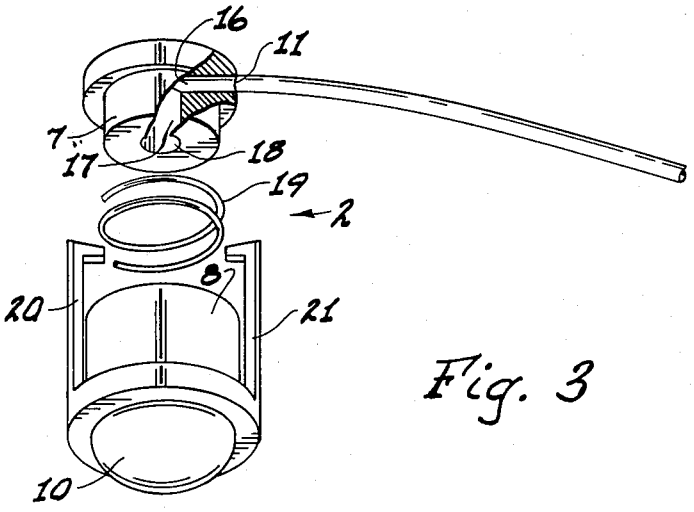
FIG. 3 is a detached exploded perspective view showing the parts and configuration of the ink dispenser unit of this invention.

In FIG. 1, a card-marking device 1 assembled and ready for attachment to the user is shown. The marking device 1 comprises an ink-dispensing portion 2 and an ink reservoir 3 which are connected by a plastic, rubber or other type tube 4. The ink reservoir 3 is a bottle having an ink exit portion 6 which is adapted to be connected to flexible tube 4 in a fluid tight fashion. The bottle or reservoir 3 can be made of any flexible material or any non-corrosive material depending upon the ink used. Around the outside portion of bottle 3 is a VELCRO attachment means 5 for attaching bottle 3 to the arm of the user. In lieu of VELCRO, one can use a strap or other convenient holding means adapted to connect the bottle 3 to the user's arm. The ink-dispensing portion 2 comprises a two-piece cylindrical structure on its outside. This two-piece cylindrical structure comprises an upper movable cylinder 7 which telescopes into a lower cylinder 8. The upper or cap cylinder 7 has a flat disc-like top 9 which is easily pressed by a finger. The lower cylinder 8 has a bottom ink absorption section or nib 10 which comprises the ink-dispensing means of the unit. In the outer peripheral portion of upper cap cylinder 7 is a tube opening 11 into which the tube 4 fits in a fluid tight manner. Opening 11 extends from the outside of upper cylinder 7 to the interior so as to provide tube 4 access to the interior of cylinder 7 and to aperture 18 as shown in FIG. 3. The tube 4 can enter ink-dispensing portion 2 at any suitable location, preferably, however, at the upper part of ink-dispensing means 2. A VELCRO or other attaching means 12 is positioned adjacent dispensing portion 2 and adapted to secure dispensing portion 2 to a finger, preferably the forefinger. Flexible clamps 20 and 21 hold cylinders 7 and 8 together and permit downward movement when pressed. After release, cylinder 7 springs upward so that aperture 18 (as shown in FIG. 3) no longer contacts nib 10. Dispensing portion 2 is constructed of non-corrosive materials such as plastics, i.e. polycarbonates, polyurethanes, polystyrenes, polyethylene or the like. The tube 4 is a conventional readily available tube such as polyethylene tubes or commercially available tubes used in soap sprays, detergent sprays, etc. The ink bottle 3 is constructed of suitable non-reactive materials that will not interfere with the ink composition. Many ink containers and marking containers available today would be suitable conditioned on having means to be hermetically sealed and prevent any leakage of ink therefrom. The straps 5 and 12 are preferred to be VELCRO straps, but any suitable straps or strings or other securing means may be used if suitable.

Figure 2:
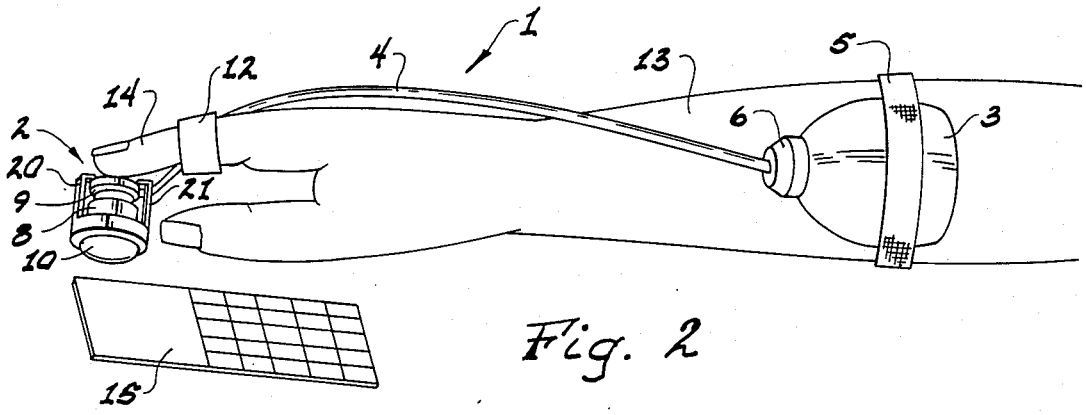
FIG. 2 is a perspective view of the unit of this invention as it is attached to the finger and arm of the user ready for use.

In FIG. 2, marking device 1 is shown attached to the user's arm 13 and forefinger 14. The ink contained in ink bottle or reservoir 3 will easily flow through tube 4 to ink dispenser 2 and saturate nib 10. From nib 10 it can easily be transferred to card or substrate 15 by contacting nib 10 with the substrate to be marked. The user merely presses down on disc 9 and ink will flow down to nib 10. Disc 9 is spring loaded as shown in FIG. 3 and upon exertion of pressure permits flow of ink, and release of pressure by the finger 14 prevents additional flow of ink to nib 10. Attachment means 20 and 21 hold cylinders 7 and 8 together in a movable manner. They can be clamps or flexible straps which do not permit separation of cylinders 7 and 8 and permit movement of cap cylinder 7 when pressed down.

In FIG. 3 an exploded view of ink dispenser 2 is shown where upper movable cap cylinder 7 is detached from its telescoping position in lower cylindrical means 8. Tube 4 enters upper cap cylinder 7 in a leakproof manner at aperture 11. The ink flows through tube 4 through inner conduits 16 and 17 and out aperture 18. When disc 9 is pushed downward, ink-filled aperture 18 contacts the inner side of nib 10 and wets nib 10. Nib 10 extends from the inner surface of cylinder 8 to the outside surface on the bottom of cylinder 8, thereby absorbing ink on the inside and transferring ink from its outer surface. The ink is absorbed throughout the thickness of nib 10. The ink saturates ink absorption means or nib 10 and is then ready for ink transfer to a substrate or card. Nib 10 can be made from any absorbent material such as cloth, felt, synthetic materials or the like. Upper movable cap cylinder 7 telescopes into lower cylinder 8 and is freely movable therein. When seated in cylinder 8, movable cap cylinder 7 will not touch the inner portion of absorbent nib 10 but when disc top portion 9 is pressed downward, the ink-filled aperture 18 contacts the inner face of nib 10 and wets it as above described. The ink then wets nib 10 throughout and can be transferred from its exterior portion to a substrate. Spring means 19 fits into the inner portion of lower cylinder 8 and upper cylinder 7 and keeps upper cylinder 7 away from nib 10 until demand when it is pressed down. The inner portion of cylinder 8 is hollow so as to present a housing for upper cylinder 7 and spring means 19. All connections of tube 4 to elements of the marking unit are in a leakproof manner. Cylinder 7 fits tightly into cylinder 8 to prevent any ink leakage therefrom.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A marking device comprising in combination an ink container, an ink dispensing unit and a flexible tube, said flexible tube connected in a liquid tight and liquid flow manner to said ink container and said ink dispensing unit and having means that permits the flow of ink from said ink container to said ink dispensing unit, said ink dispensing unit comprising a movable upper and lower cylinder means, said upper cylinder means telescopically fitted into said lower cylinder means, said ink dispensing unit having a conduit in liquid flow connection with said flexible tube, said lower cylinder means having an ink absorption means extending to the outside of its surface, said ink dispensing unit having means to contact said conduit with said ink absorption means, said ink container and said ink dispensing unit having means to be connected to a finger and arm of a user.

2. The device of claim 1 wherein said ink dispensing unit comprises a spring, fitted in the inner portion of at least one of said lower and upper cylinder means.

3. The device of claim 1 wherein said ink absorption means is a nib which extends from the inner portion of said lower cylinder means to the outer portion of said lower cylinder means.

4. The device of claim 1 wherein said movable upper cylinder means has aperture means to connect to said tube and conduit means coextensive with said aperture means, said conduit means located in the bottom inner portion of upper cylinder means and capable of transferring ink to said ink absorption means.

5. The device of claim 1 wherein said movable upper cylinder means has at its top outer portion a disc-like section adapted to be pressed by a finger to thereby move said upper cylinder means in a downward direction to thereby wet said ink absorption means.

6. The device of claim 1 wherein said marking device comprises means capable of transferring ink from said ink container to said ink absorption means.

7. The device of claim 1 wherein said upper cylinder means telescopically fits into said lower cylinder means in a substantially tight fashion to prevent any liquid from escaping therefrom.

8. An ink marking device comprising in combination an ink reservoir, an ink dispenser means, and a flexible tube, said flexible tube connecting said ink reservoir to said ink dispenser means in a liquid tight fashion, said ink reservoir comprising a bottle with a bottlecap having liquid tight means to connect onto said flexible tube in a liquid flow manner, said cap being removable from said bottle to facilitate refilling said bottle, said ink dispensing means comprising a movable upper and a lower cylinder means, said upper cylinder means telescopically fitted into said lower cylinder means, said ink dispensing means having a conduit in liquid flow connection with said flexible tube, said lower cylinder means having an ink absorption means extending to the outside of its surface, said ink dispensing means unit having means to contact said conduit with said ink absorption means, said ink container and said ink dispensing means having means to be connected to a finger and arm of a user.

9. The device of claim 8 wherein said upper cylinder means has at its top outer portion a disc-like section adapted to be pressed by a finger to thereby move said upper cylinder means in a downward direction to thereby wet said ink absorption means.

* * * * *